United States Patent [19]

Rogers

[11] 4,039,111

[45] Aug. 2, 1977

[54] PALLET NAILING DEVICE

[76] Inventor: Irney Lee Rogers, 16638 Holton, Valinda, Calif. 91744

[21] Appl. No.: 710,407

[22] Filed: Aug. 2, 1976

[51] Int. Cl.[2] ..... B27F 7/02

[52] U.S. Cl. ..... 227/30; 227/101; 227/152; 100/258 A; 72/441

[58] Field of Search ..... 227/27, 30, 100, 101, 227/120, 152, 153; 100/258 R, 258 R; 72/441; 83/626, 635

[56] References Cited

U.S. PATENT DOCUMENTS

| | | | |
|---|---|---|---|
| 1,469,689 | 10/1923 | Prius | 100/258 R |
| 2,446,823 | 8/1948 | Grant | 100/258 A |
| 3,207,403 | 9/1965 | Stoddard et al. | 227/101 |
| 3,587,452 | 6/1971 | Krause | 100/258 R |
| 3,876,128 | 4/1975 | Feren | 227/152 |

*Primary Examiner*—Granville Y. Custer, Jr.
*Attorney, Agent, or Firm*—Edgar W. Averill, Jr.

[57] ABSTRACT

An automatic nailing machine for fabricating wooden pallets. The device has a hammer pin support bar vertically movable within a frame and horizontally aligned by a first horizontal alignment bar mounted on the frame. A nail feed and support bar is mounted below the hammer pin support bar, is moved upwardly when the hammer pin support bar is moved to its uppermost position, moves downwardly with said hammer pin support bar when said hammer pin support bar begins its downward travel and then remains stationary as the hammer pin support bar continues its downward movement. A plurality of hammer pins are mounted on the hammer pin support bar and cooperate with a plurality of nail holding devices mounted on the nail feed and support bar. The nail feed and support bar is horizontally aligned by a bar affixed to the frame and lined to the nail feed and support bar.

10 Claims, 11 Drawing Figures

FIG. 1.
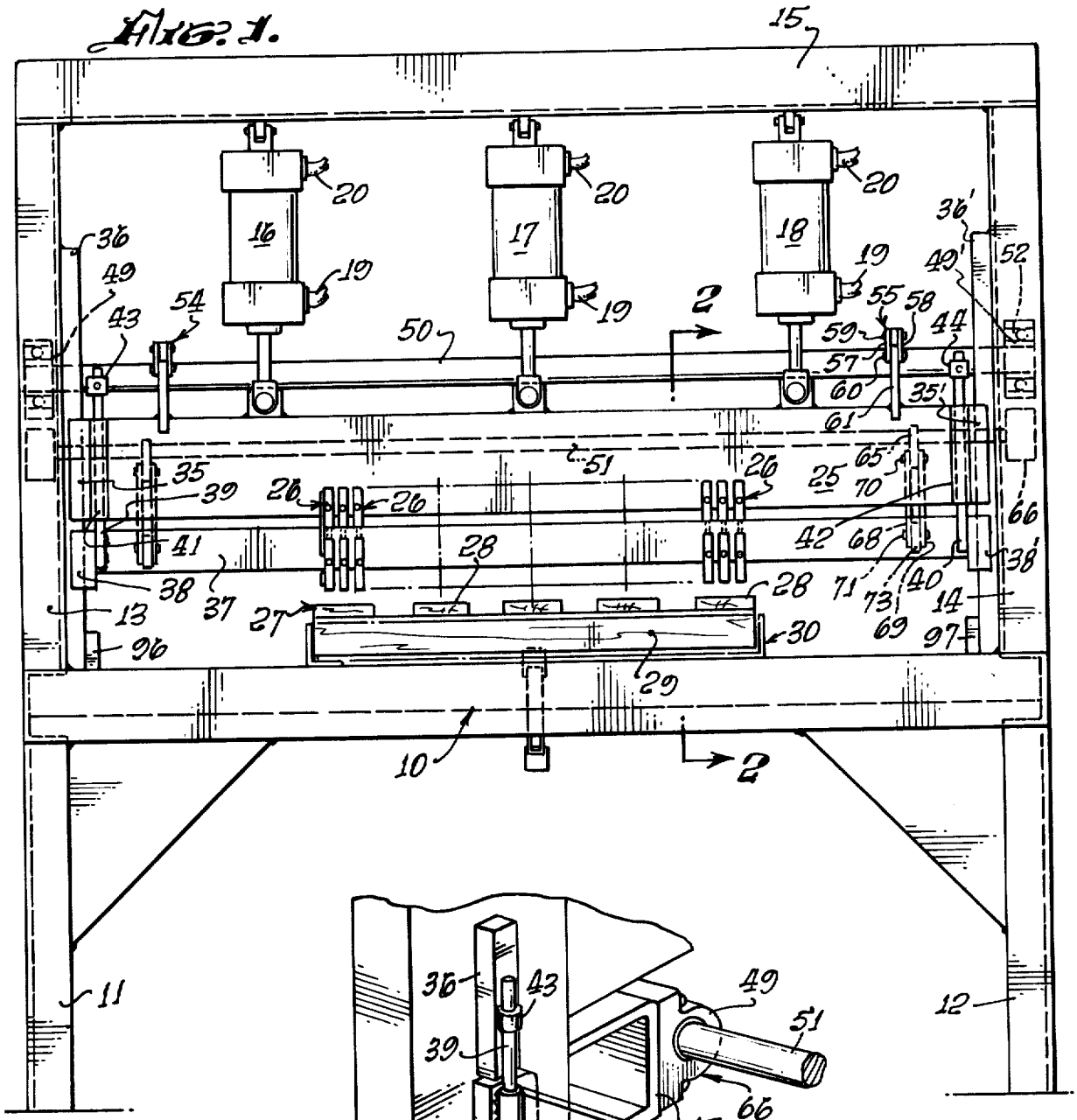
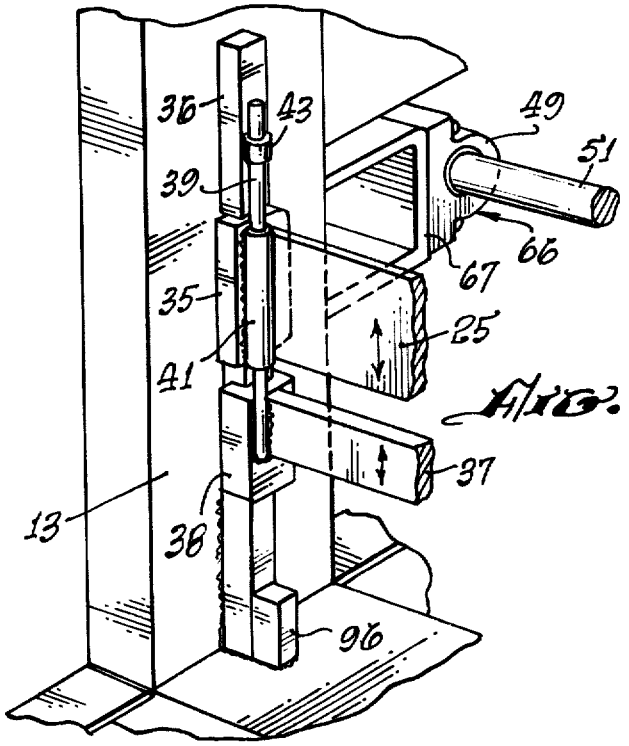
FIG. 3.

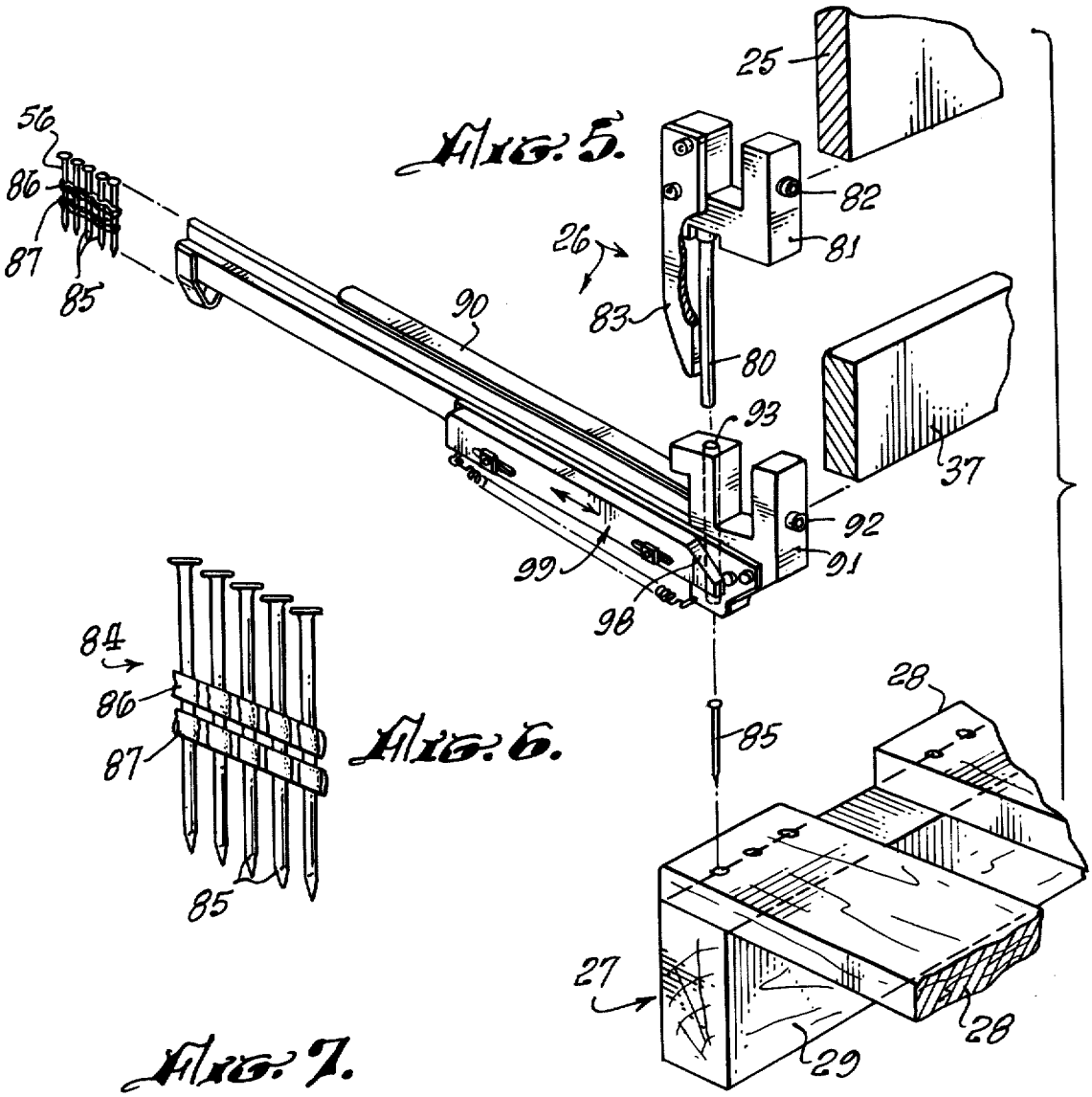
FIG. 5.
56
86
87
85
90
26
83
80
25
82
81
93
37
92
91
99
98
85
28
27
29
FIG. 6.
84
86
87
85
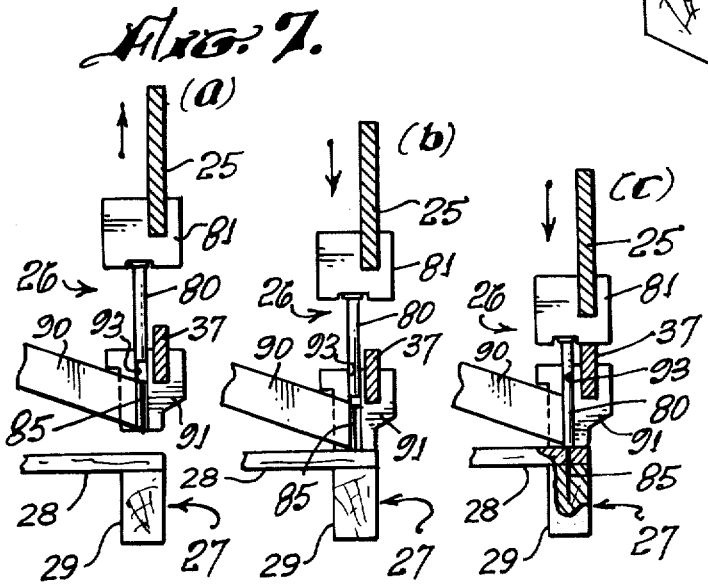
FIG. 7.
(a)
(b)
(c)
25
81
26
80
90
93
37
85
91
28
29
27

FIG. 8.
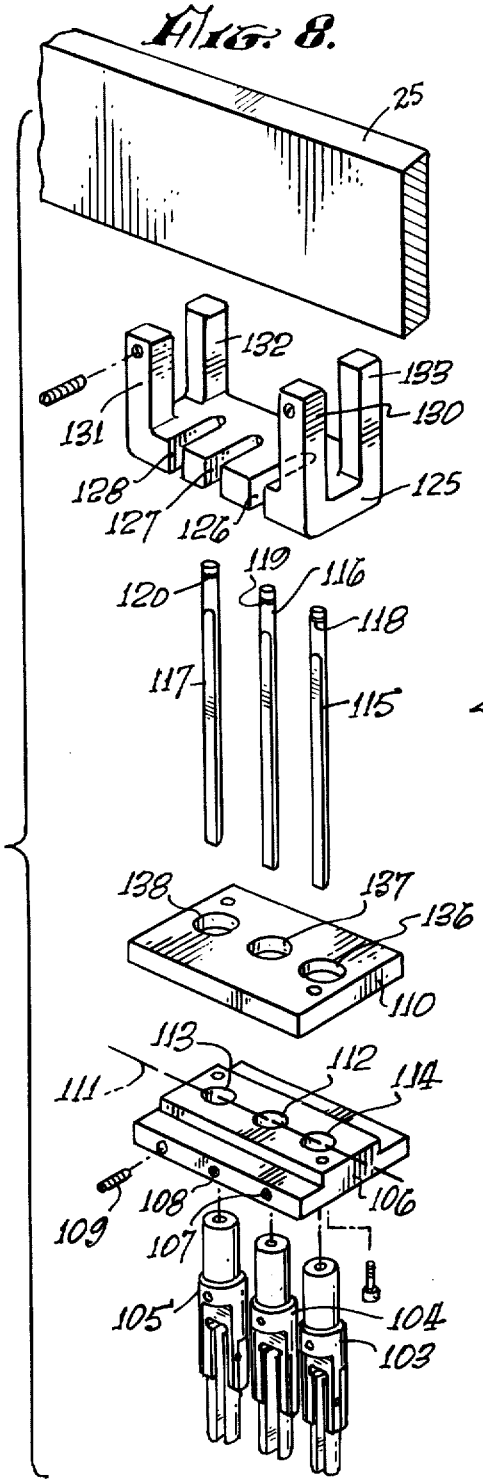
FIG. 9.
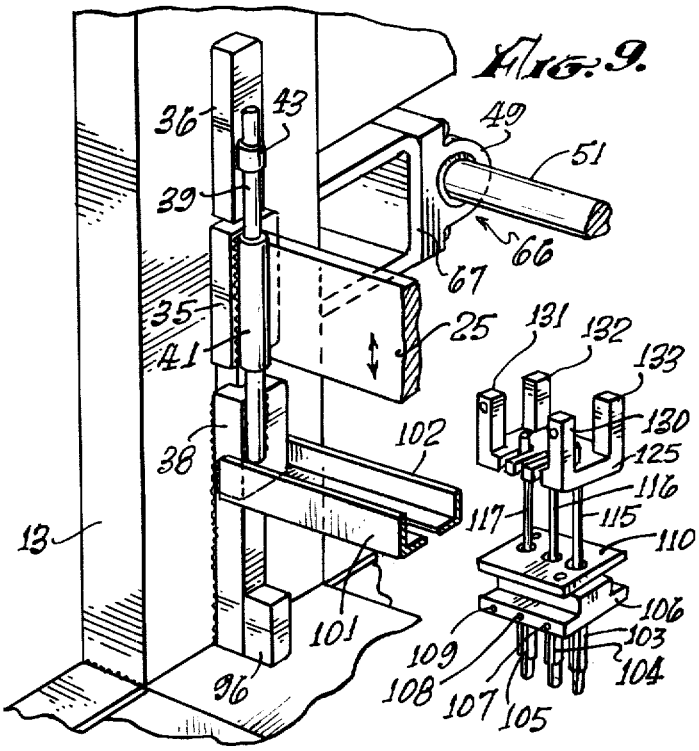
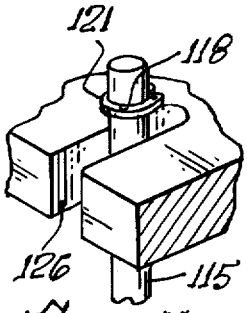
FIG. 11.
FIG. 10.
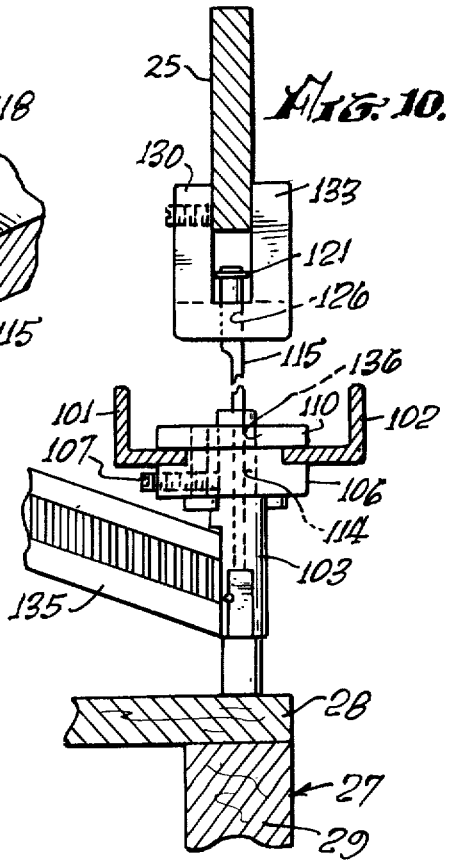

PALLET NAILING DEVICE

BACKGROUND OF THE INVENTION

The field of the invention is automatic nailing machines and more particularly the invention relates to machines for fabricating wooden pallets. in labor Automatic nailing machines for fabrication of pallets have been in widespread use for many years. One such machine is disclosed in U.S. Pat. No. 2,856,606 and further refinements of such machines are disclosed in U.S. Pat. No. 3,591,067. The machines disclosed in the above two patents are highly complex, somewhat simpler devices have also been devised, one of such being shown in U.S. Pat. No. 1,949,108. The purpose of such machines is to decrease the amount of labor required to fabricate wooden pallets and with continued increases inlabor costs, interest in such machines continues. The machines of the prior art suffer from several shortcomings. Machines such as those shown in U.S. Pat. No. 3,591,067 are highly complex, very expensive and are relatively difficult to repair and maintain. Machines such as that shown in U.S. Pat. No. 3,207,403 utilize a mechanical nail driving linkage and in the event the machine becomes jammed severe damage can result.

For speed of production, it is advantageous to drive a plurality of nails at one time. For instance, for a pallet having five deck boards using 3 nails per board it would be desirable to drive 15 nails with one stroke of the machine. Attempts to achieve this result have led to the complex machinery such as shown in U.s. Pat. No. 3,591,067. Prior attempts to simplify the machinery have led to inoperative devices or devices with unsatisfactory service life.

SUMMARY OF THE INVENTION

It is thus an object of the present invention to provide a pallet nailing machine having the capability of driving a relatively large number of nails in a single stroke while at the same time being of a basically uncomplicated design.

The present invention is for an automatic nailing machine for fabricating pallets by nailing a plurality of deck boards to a plurality of stringers. The machine utilizes hydraulic pressure to drive a plurality of hammer pins which are connected to a hammer pin support bar which is hydraulically driven. The hammer pin support bar holds a nail feed and support bar which is moved upwardly when the hammer pin support is moved to its uppermost position and moves downwardly with the hammer pin support bar when the hammer pin support bar begins its downward travel and remains stationary as said hammer pin support bar continues its downward movement. A plurality of nail holding devices are mounted on the nail feed and support bar and are positioned to cooperate with hammer pins affixed to the hammer pin support bar. A first horizontal alignment bar is mounted rotatingly on the frame of the machine and has at least two arms. Each arm is rigidly affixed at one end to the rotatable alignment bar and pivotally linked at the other end to the hammer pin support bar. Further, a second horizontal alignment bar is rotatingly mounted on the frame and has at least two arms. Each arm is rigidly affixed at one end to the alignment bar and pivotally linked at the other end to the nail feed and support bar.

BRIEF DESCRIPTION OF THE DRAWINGS

FIG. 1 is a front elevational view of the automatic nailing machine of the present invention.

FIG. 3 is an enlarged fragmentary perspective view showing the guide means for the hammer and nail support bars.

FIG. 5 is an exploded perspective view of the nail driving assembly of the machine of the present invention.

FIG. 6 is an enlarged side elevation of a plurality of collated nails of the type useful with the machine of the present invention.

FIG. 7 is a fragmentary cross-sectional side elevation depicting the nail driving assembly of the machine of the present invention.

FIG. 8 is an exploded perspective view of an alternate nail driving assembly of the machine of the present invention.

FIG. 9 is an enlarged fragmentary perspective view showing an alternate configuration of the nail magazine support bar.

FIG. 10 is a side view partly in cross section of the nail driving assembly of FIG. 8 as mounted on the hammer pin drive bar.

FIG. 11 is an enlarged fragmentary view of the upper end of a hammer pin mounted in a support member.

DESCRIPTION OF THE PREFERRED EMBODIMENTS

Figure 2:
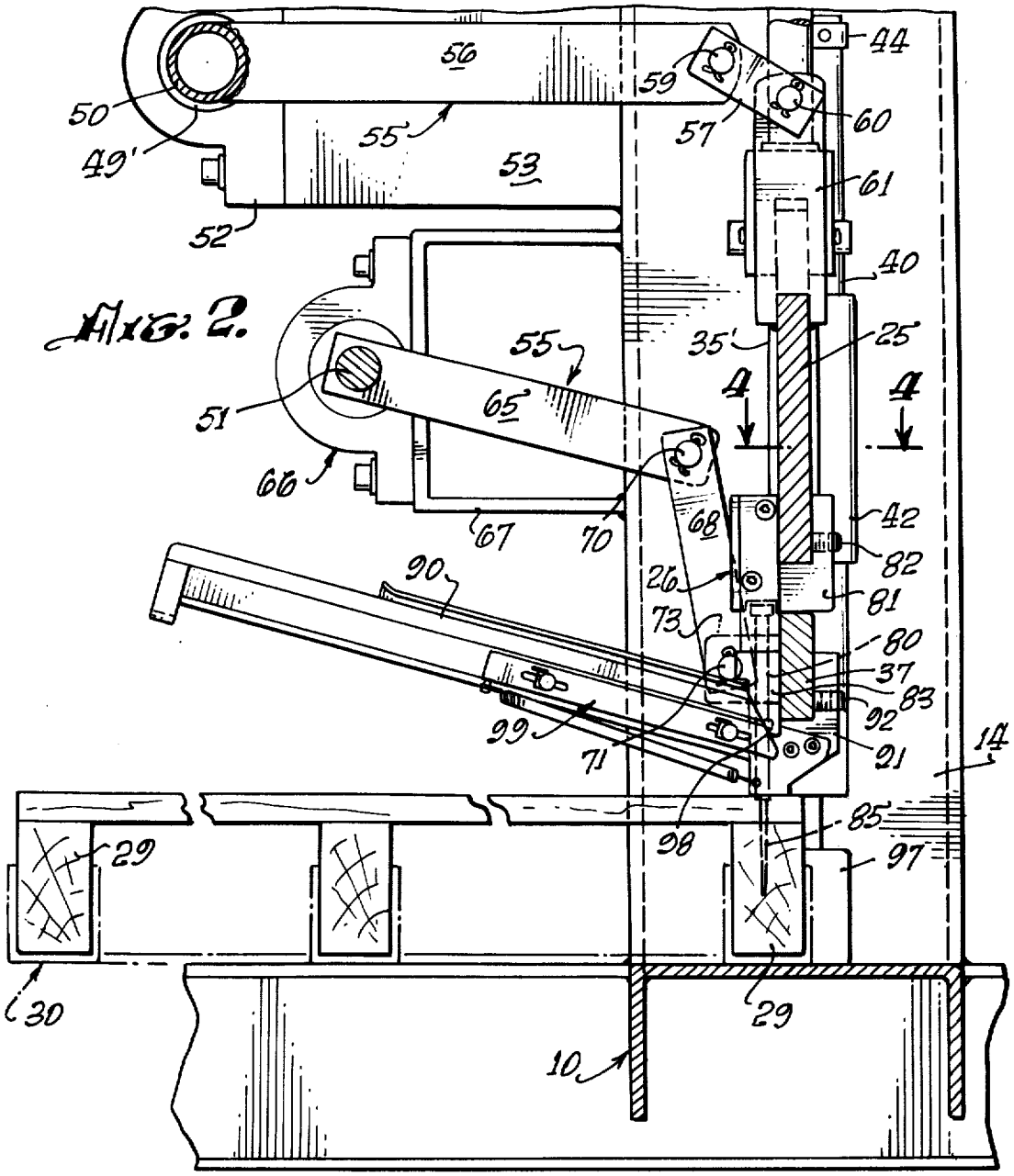
FIG. 2 is a cross-sectional view taken along line 2—2 of FIG. 1.

The automatic nailing machine is shown in end view in FIG. 1 and has a floor or bed 10 fabricated utilizing a channel iron frame which is supported by four legs, two of which are shown in FIG. 1 and indicated by reference characters 11 and 12. The bed supports a frame comprising a pair of upright members 13 and 14 which hold a cross bar 15. Members 13, 14 and 15 may also be fabricated from channel iron and must, of course, have sufficient strength to drive the desired number of nails. For instance, the machine depicted in FIG. 1 is capable of driving 15 nails at one stroke and channel iron 3½ by 10 inches has been found satisfactory for members 13 and 14 and channel iron 4 by 10 inches is satisfactory for cross bar 15.

Cross bar 15 supports three air cylinders 16, 17 and 18. Each air cylinder has an air inlet for raising or contracting the piston which is indicated by reference character 19 and an air inlet 20 for extending the piston. While the present invention is shown utilizing air cylinders, other hydraulic media such as oil may be used instead. The use of hydraulic drive means in place of a mechanical drive has a substantial advantage in the machine of the present invention in the event of jamming which, in a mechanical drive device, can cause severe damage to the machine. With air or hydraulic drive, a jammed machine does not necessarily cause significant damage since the machine may stop in a partially depressed position.

Air cylinders 16, 17 and 18 are connected to hammer pin support bar 25, a portion of which is also shown in FIG. 3 in perspective view. The means for guiding and aligning the hammer pin support bar forms an important part of the present invention. While the air cylinders provide the upward and downward motivation for support bar 25, if the bar were not held in accurate horizontal position, a binding would result which could cause a jamming of the machine or reduce the power transmitted to the hammer pins. The details of this alignment mechanism are described below.

Hammer pin support bar 25 has a plurality of hammer assemblies which are shown in more detail in FIG. 5 and will be described with respect to that Figure. These hammer assemblies are indicated in FIG. 1 by reference character 26 and may be placed sufficiently close together to drive three nails into a single pallet deck board. While only six hammer assemblies are shown in FIG. 1, it is readily seen that 15 hammer assemblies could be utilized to nail each deck board of the pallet 27 which is shown in FIG. 1. Furthermore, additional hammer assemblies could be added for larger pallets or pallets having a larger number of deck boards. The deck boards are indicated by reference character 28 and these deck boards are nailed into a series of runners one of which is indicated in FIG. 1 by reference character 29. A typical pallet will have three runners and thus would be completely assembled by three strokes of the machine. The pallet may be held in a jig 30 which may be adapted for the particular size of pallets being made.

Hammer pin support bar 25 is guided generally by channel 35 which rides along bar 36 which is welded to upright 13 (see FIG. 3). A similar channel member and bar is located at the other end of bar 25. A nail feed and support bar 37 is held below bar 25 and, like bar 25, is supported by a channel member 38 which rides on bar 36. Nail feed and support bar 37 is moved in a vertical direction by the hammer pin support bar 25. Rods 39 and 40 are welded to each end of bar 37 and pass sleeves 41 and 42 welded to bar 25. A lift lug 43 is affixed to rod 39 and when lug 43 contacts sleeve 41 further upward movement of sleeve 41 and its associated bar 25 cause bar 37 to be lifted. Similarly, lift lug 44 is affixed to rod 40 and contacts sleeve 42 as support bar 25 moves upwardly.

Figure 4:
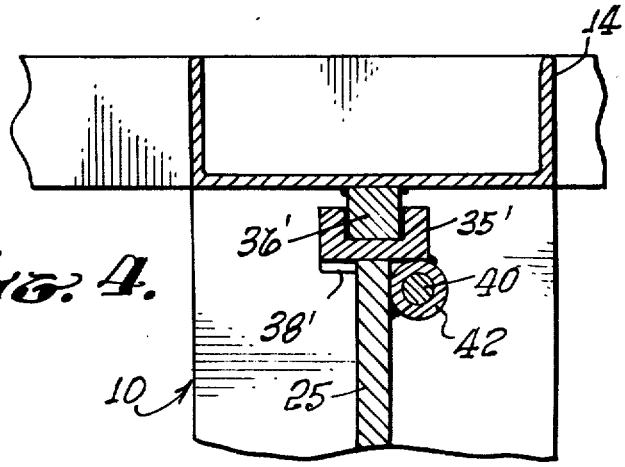
FIG. 4 is a cross-sectional view taken along line 4—4 of FIG. 2.

After the hammer pin support bar 25 has reached its maximum upward elevation and air is introduced into the upper chambers of cylinders 16 through 18, support bars 25 and 37 begin to move downwardly in unison until hammer assemblies 26 contact deck boards 28. At that point, support bar 37 becomes stationary and the hammer pin support bar 25 continues its downward movement and sleeves 41 and 42 slide downwardly along rods 39 and 40. Ultimately, the hammer pins drive the nails into the deck boards and runner in a manner described more fully below. The interconnection of hammer pin support bar 25 with rod 40 is shown more clearly in FIG. 4. Channel member 35' rides on bar 36' and guide sleeve 42 surrounds rod 40 channel member 38', shown in FIGS. 1 and 4, rides on bar 36' in a manner analagous to channel member 38 and bar 36 shown most clearly in FIG. 3.

The accurate horizontal positioning of support bars 25 and 37 is an important feature of the present invention. This horizontal positioning is brought about by a pair of horizontal guide rods 50 and 51 shown in end view in FIG. 2. Rod 50 is rotatably supported in bearings 49 and 49' shown in FIG. 1. Bearing 49' is held in base 52 which is affixed to pillow block 53 welded to upright 14. As shown most clearly in FIG. 1, rod 50 has a pair of link assemblies indicated generally at 54 and 55. Link assembly 55 has a bar 56 which is welded at one end to horizontal guide rod 50 and is connected to bar 25 through a pair of links 57 and 58 by pins 59 and 60. Pin 60 is rotatingly affixed to arm 61 which is welded to bar 25. Link assembly 54 has a similar assemblage to that described above for assembly 55.

Accurate horizontal guidance is also important for nail feed and support bar 37. A bar 65 is welded to horizontal guide rod 51 which is rotatingly supported in bearing assembly 66 which in turn is bolted to pillow block 67 welded to upright 14. Bar 65 is pinned to a pair of links 68 and 69 by pin 70. Links 68 and 69 are similarly pinned by pin 71 which passes through bar 73 welded to the nail feed and support bar 37.

The hammer assembly is shown in FIG. 5. Hammer pin 80 has a generally crescent cross-sectional configuration so that it may strike a single collated nail such as that shown in FIG. 6. Hammer pin 80 is affixed to support frame 81 which in turn is held to hammer pin support bar 25 by an Allen screw 82. The position of support frame 81 on bar 25 may be adjusted by loosening screw 82 and tightening it when the frame is in the desired position. An accuating cam 83 is affixed to support frame 81 and serves to advance the collated nails 84.

As shown in FIG. 6, collated nails 84 comprise a plurality of nails 85 held together by a pair of plastic beads 86 and 87. While various means may be used to feed loose or uncollated nails, the particular type of nails used does not form a part of the present invention and any means for feeding nails to the hammer may be utilized as long as its dimensions permit sufficient proximity to drive the desired number of nails in one stroke. The collated nails 84 are held in a nail chamber 90 which is affixed to support frame 91 which is adjustably tightened onto nail feed and support bar 37 by use of Allen screw 92. Hammer pin 80 passes through the cylindrical opening 93 in support frame 91.

The nail driving action is shown most clearly in FIG. 7. Bars 25 and 37 are shown in a raised configuration in FIG. 7 (a). As bars 25 and 37 move downwardly, support frame 91 contacts deck board 28 as shown in FIG. 7 (b). As bar 25 continues to move downwardly, hammer 80 contacts nail 85 and drives the same through deck board 28 into runner 29.

Actuating cam 83 contacts the actuated cam surface 98 which reciprocates the advancing means 99 to assist the feeding of the collated nails 84 to opening 93.

A pair of safey stops 96 and 97 are welded to the bottom of bars 36 and 36' to protect the nailing assembly from damage in the event the mechanism is activated at a time when there is no pallet on the floor or bed 10.

An alternate configuration of a hammer pin support assembly as shown in FIGS. 8 through 11. As shown in FIG. 9 the nail feed and support bar is made from two angle irons 101 and 102 which are supported at each end by channel members 38 and 38'. Angle irons 101 and 102 hold the hammer pin support assembly shown in FIG. 8 to the support assembly. The support assembly holds three nail feed heads 103, 104 and 105. Feed heads 103 through 105 are held in block 106 shown most clearly in FIG. 8. Three Allen screws 107 through 109 hold the nail feed heads in block 106. Block 106 is held to angle iron 101 and 102 by clamp member 110 which is bolted to block 106. Clamp member 110 has 3 enlarged openings passing therethrogh to permit the upper ends of nail feed heads 103 through 105 to pass through the clamp member. The nail feed heads can be positioned on a diagonal with respect to the longitudinal axis of block 106. As shown best in FIG. 8 central axis 111 passes through the center of holes 112, 113 and 114. Since the nail drive pins are mounted in slots 126, 127 and 128 the nail feed heads can be positioned away from central axis 111 and the drive pins will remain in the slots. This permits the nails to be driven at 3 different positions along stringer 29 which tends to reduce splitting of the stringer.

Three drive pins 115, 116 and 117 as shown in FIG. 8 and these pass through nail feed heads 103, 104 and 105 respectively. Each hammer pin has a groove indicated by reference characters 118, 119 and 120 near the upper ends thereof which hold a circlip 121 shown most clearly in FIG. 11. This circlip permits hammer pin support member 125 to lift the hammer pins by contact with slots 126, 127 and 128 located therein.

Hammer pin support member 125 is held to hammer pin support bar 25 by a pair of bolts which pass through legs 130 and 131 of support member 125. Legs 132 and 133 contact the opposite side of hammer pin support bar 25 as shown most clearly in FIG. 10.

As the hammer pin support bar 25 moves downwardly, it contacts the upper end of hammer pins 115 through 117. The lower end of each hammer pin contacts a nail held in a nail magazine 135. Each nail feed head has a nail magazine bolted thereto. This portion of the apparatus functions in a manner analogous to that shown in FIG. 7 which is described above.

As is evident from FIG. 9, the hammer pin support 25 bar lifts the nail feed and support bar by the contact of lift lug 43 with sleeve 41. In this way, hammer pin support bar 25 need only lift the support member 125 and the hammer pins themselves since angle irons 101 and 102 and the devices attached to them are lifted by rods 39 and 40. Also as set forth above, the nail feed heads can be assembled in pairs of three and five sets of three-pin assemblies may readily be mounted on angle irons 101 and 102. If desired a larger or smaller number of sets can be mounted.

The machine of the present invention will readily drive 15 nails per stroke. It is believed that the positioning of the hammer pins directly below support bar 25 as shown in FIGS. 8 through 11 tends to improve the reliability of the machine as compared to the non-axial alignment shown best in FIG. 7 of the drawings.

Alternate configurations of hammer pin support members could be used in place of the slotted support member 125. It is useful however that the pins be mounted directly below the hammer pin support bar and also that they be longitudinally moveable along hammer pin support bar 25 so that different sizes of pallets may be manufactured with the same machine.

The holes 136, 137 and 138 may be axially alligned in clamp 110. These holes are preferably larger than holes 112 through 114 so that a non-axial allignment of openings 112, 113 and 114 may be used.

The ability of the nailing machine of the present invention to drive a large number of nails with one stroke is believed to result from a combination of the action of the air cylinders combined with the mass and resulting momentum of the hammer pin support bar 25. Air cylinders having a diameter of 6½ inches and a height of 14½ inches have been successfully used with a hammer pin support bar 8 inches high and 1 inch wide. Such a device is capable of driving 15 nails at one stroke.

It is important that horizontal guide rod 50 be of sufficient torsional strength to hold the heavy hammer pin support bar 25 in a horizontal position. A rod having a 2¼ inch outside diameter has successfully positioned the above-described support bar. The nail feed and support bar being of lighter weight was successfully positioned by a guide rod having an outside diameter of 1 inch. An air pressure of 80 to 100 lbs. per square inch is sufficient to operate a machine having the above-described dimensions.

The present embodiments of this invention are thus to be considered in all respects as illustrative and not restrictive, the scope of the invention being indicated by the appended claims rather than by the foregoing description. All changes which come within the meaning and range of equivalency of the claims therefore are intended to be embraced therein.

What is claimed is:

1. An automatic nailing machine for nailing deck boards to stringers to fabricate pallets of the type utilizing hydraulic pressure to drive a plurality of hammer pins, said device comprising:

a frame;

hydraulic drive means connected to said frame;

a hammer pin support bar carried by said frame, vertically moveable in the frame and driven by the hydraulic drive means;

a nail feed and support member carried by said frame, vertically moveable in the frame, mounted below said hammer pin support bar and attached thereto by at least two lifting members, which members connect said hammer pin support bar to said nail feed and support member, said lifting members having stop means which permit the initial movement of the hammer pin support bar without the movement of the nail feed and support member but further upward movement of the hammer pin support bar causes the nail feed and support member to be lifted by said lifting members so that the nail feed and support member is moved upwardly when the hammer pin support bar is moved to its uppermost position, moves downwardly with said hammer pin support bar when said hammer pin support bar begins its downward travel and remains stationary as said hammer pin support bar continues its downward movement;

a plurality of hammer pins mounted on said hammer pin support bar;

a plurality of nail holding devices mounted on said nail feed and support member and positioned to cooperate with said hammer pins whereby each of said hammer pins contact a nail held in said nail holding device and drives it downwardly;

a first horizontal alignment bar mounted on said frame and having at least two arms rigidly affixed at one end to said first bar and pivotally linked at their other end to said hammer pin support bar; and a second horizontal alignment bar mounted on said frame and having at least two arms rigidly affixed at one end to said second bar and pivotally linked at their other end to said nail feed and support bar.

2. The device of claim 1 wherein said hydraulic drive means comprises a plurality of air cylinders.

3. The device of claim 1 wherein said first horizontal alignment bar has two arms rigidly affixed thereto.

4. The device of claim 1 wherein said second horizontal alignment bar has two arms affixed thereto.

5. The device of claim 2 wherein said hydraulic drive means comprises three air cylinders.

6. The device of claim 1 wherein said nail feed and support member is a rectangular bar.

7. The device of claim 1 wherein said nail feed and support member is a pair of angle iron bars.

8. The device of claim 7 wherein said nail holding devices are longitudinally adjustably mounted along said nail feed and support member.

9. The device of claim 1 wherein said hammer pins are held in a slotted member affixed to the hammer pin support bar and positioned so that hammer pin support bar directly contacts the hammer pins.

10. The device of claim 9 wherein said slotted member has three slots with three hammer pins received therein.

* * * * *